US005594628A

United States Patent [19]

Reuter et al.

[11] Patent Number: 5,594,628

[45] Date of Patent: Jan. 14, 1997

[54] DECORATIVE EXTERIOR LIGHTING SYSTEM FOR USE ON A BUILDING

[76] Inventors: John R. Reuter, 2065 Carroll Eastern Rd., Lancaster, Ohio 43130; Raymond K. Kline, Box 68, Haydenville, Ohio 43127

[21] Appl. No.: 412,996

[22] Filed: Mar. 29, 1995

[51] Int. Cl.[6] ..... F21V 21/00

[52] U.S. Cl. ..... 362/249; 362/152; 362/359; 362/374

[58] Field of Search ..... 362/152, 249, 362/352, 353, 354, 359, 360, 374

[56] References Cited

U.S. PATENT DOCUMENTS

| | | | |
|---|---|---|---|
| 1,485,472 | 3/1924 | Van Bloem . | |
| 3,692,993 | 9/1972 | Robinson | 240/10 |
| 4,626,965 | 12/1986 | Gupta et al. | 362/33 |
| 5,311,414 | 5/1994 | Branham, Sr. | 362/359 |
| 5,404,279 | 4/1995 | Wood | 362/249 |

*Primary Examiner*—Ira S. Lazarus
*Assistant Examiner*—Alfred Basichas

[57] ABSTRACT

A decorative exterior lighting system including an elongated housing with a generally L-shaped upper section hingably coupled to a generally L-shaped lower section and with the lower section positionable away from the upper section to place the housing in an opened orientation and further positionable in facing contact with the upper section to place the housing in a closed orientation; and an electrical lighting circuit coupled to the upper section of the housing and further including a plurality of electrically conductive light sockets, a plurality of lights with each light secured within a separate light socket, a female electrical plug coupled to the upper section of the housing, a male electrical plug coupled to the upper section of the housing at a location remote from the female electrical plug, and a plurality of electrically conductive wires interconnecting the plugs and light sockets and with the lights providing illumination when the lighting circuit is electrically energized and the housing is placed in the opened orientation.

5 Claims, 4 Drawing Sheets

DECORATIVE EXTERIOR LIGHTING SYSTEM FOR USE ON A BUILDING

BACKGROUND OF THE INVENTION

1. Field of the Invention

The present invention relates to a decorative exterior lighting system for use on a building and more particularly pertains to providing an ornamental illuminated effect when placed in an opened orientation and further providing a trimmed appearance to the building when placed in a closed orientation with a decorative exterior lighting system.

2. Description of the Prior Art

The use of decorative lighting systems is known in the prior art. More specifically, decorative lighting systems heretofore devised and utilized for the purpose of providing an ornamental effect are known to consist basically of familiar, expected and obvious structural configurations, notwithstanding the myriad of designs encompassed by the crowded prior art which have been developed for the fulfillment of countless objectives and requirements.

By way of example, U.S. Pat. 3,692,993 to Robinson discloses a lighting fixture unit. U.S. Pat. No. 4,999,751 to Chen discloses an innovative Christmas light assembly structure. U.S. Pat. 5,024,406 to Ketcham discloses a device for hanging outdoor Christmas lights. U.S. Pat. 5,067,061 to Prickett discloses a decorative exterior trim lighting system. U.S. Pat. 5,311,414 to Branham, Sr. discloses a Christmas light mounting apparatus.

While these devices fulfill their respective, particular objective and requirements, the aforementioned patents do not describe a decorative exterior lighting system for use on a building that provides decorative illumination in one mode of operation and serves as trim for a building in another mode of operation.

In this respect, the decorative exterior lighting system for use on a building according to the present invention substantially departs from the conventional concepts and designs of the prior art, and in doing so provides an apparatus primarily developed for the purpose of providing an ornamental illuminated effect when placed in an opened orientation and further providing a trimmed appearance to the building when placed in a closed orientation.

Therefore, it can be appreciated that there exists a continuing need for new and improved decorative exterior lighting system for use on a building which can be used for providing an ornamental illuminated effect when placed in an opened orientation and further providing a trimmed appearance to the building when placed in a closed orientation. In this regard, the present invention substantially fulfills this need.

SUMMARY OF THE INVENTION

In the view of the foregoing disadvantages inherent in the known types of decorative lighting systems now present in the prior art, the present invention provides an improved decorative exterior lighting system for use on a building. As such, the general purpose of the present invention, which will be described subsequently in greater detail, is to provide a new and improved decorative exterior lighting system for use on a building and method which has all the advantages of the prior art and none of the disadvantages.

To attain this, the present invention essentially comprises, in combination, a rigid insulated elongated box-shaped housing. The housing includes an upper section hingably coupled to a lower section. The upper section has L-shaped upper wall formed of a top portion and a bottom portion bounded by a flanged front edge, a rear edge, and a pair of opposed side edges extended therebetween. The upper section further has a pair of gussets. The gussets are coupled to separate side edges of the upper section to thereby create an upper holding space. Each gusset includes a pair of aligned slots disposed thereon sized and spaced for receipt of a pair of prongs of a conventional male electrical plug. The bottom portion of the upper section further has a plurality of fastener holes formed longitudinally thereon and with each fastener hole sized for receiving a fastener for securing the upper section to a recipient surface. The lower section has an L-shaped lower wall formed of a top portion and a bottom portion bounded by a slotted front edge, a rear edge, and a pair of opposed side edges extended therebetween. The lower section further has a pair of gussets coupled to separate side edges thereof to thereby create a lower holding space. The lower section is positionable away from the upper section to place the housing in an opened orientation. The front edges of the sections are snapidly securable together to place the housing a closed orientation.

A rigid planar insulated rectangular face plate is included. The face plate is perpendicularly coupled to the top portion of the upper section and extended downwards into the upper holding space to define a separate wire holding space. The face plate includes a plurality of through holes formed longitudinally therealong. Each through hole places the wire holding space in communication with the upper holding space.

An electrical lighting circuit is provided. The lighting circuit includes a plurality of threaded electrically conductive light sockets with each light socket separately disposed within a through hole of the face plate. The lighting circuit includes a plurality of incandescent lights with each light threadedly secured within a separate light socket. The lighting circuit includes a female electrical plug disposed within the upper holding space of the upper section and coupled to one of the gussets in alignment with the slots thereon. The lighting circuit includes a male electrical plug disposed within the upper holding space of the upper section and coupled to the other gusset and with the male electrical plug having a pair of prongs projected through the slots thereon. Lastly, the lighting circuit includes a plurality of sheathed electrically conductive wires disposed within the wire holding space and interconnecting the plugs and light sockets in parallel. The lights of the lighting circuit provide illumination when the circuit is electrically energized and the housing is placed in the opened orientation.

An electrical adapter plug is provided. The adapter plug has a female receptacle on one end and a male receptacle on the other end. The female receptacle of the adapter plug is removably mated with the male plug of the electrical lighting circuit and thereby allows another lighting circuit of another same exterior lighting system to be attached. Lastly, an insulated end cap is included and formed of a rectangular planar plate with a pair of prongs projected outwards therefrom. The prongs of the end cap are removably mated within the female plug of the lighting circuit to thereby prevent its exposure.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved decorative exterior lighting system for use on a building which has all the advantages of the prior art decorative lighting systems and none of the disadvantages.

It is another object of the present invention to provide a new and improved decorative exterior lighting system for use on a building which may be easily and efficiently manufactured and marketed.

It is a further object of the present invention to provide a new and improved decorative exterior lighting system for use on a building which is of durable and reliable construction.

An even further object of the present invention is to provide a new and improved decorative exterior lighting system for use on a building which is susceptible of a low cost of manufacture with regard to both materials and labor, and which accordingly is then susceptible of low prices of sale to the consuming public, thereby making such a decorative exterior lighting system for use on a building economically available to the buying public.

Still yet another object of the present invention is to provide a new and improved decorative exterior lighting system for use on a building which provides in the apparatuses and methods of the prior art some of the advantages thereof, while simultaneously overcoming some of the disadvantages normally associated therewith.

Even still another object of the present invention is to provide a new and improved decorative exterior lighting system for use on a building for providing an ornamental illuminated effect when placed in an opened orientation and further providing a trimmed appearance to the building when placed in a closed orientation.

Lastly, it is an object of the present invention to provide a new and improved decorative exterior lighting system for use on a building comprising an elongated housing including a generally L-shaped upper section hingably coupled to a generally L-shaped lower section and with the lower section positionable away from the upper section to place the housing in an opened orientation and further positionable in facing contact with the upper section to place the housing a closed orientation; and an electrical lighting circuit coupled to the upper section of the housing and further comprising a plurality of electrically conductive light sockets, a plurality of lights with each light secured within a separate light socket, a female electrical plug coupled the upper section of the housing, a male electrical plug coupled to the upper section of the housing at a location remote from the female electrical plug, and a plurality of electrically conductive wires interconnecting the plugs and light sockets and with the lights providing illumination when the lighting circuit is electrically energized and the housing is placed in the opened orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
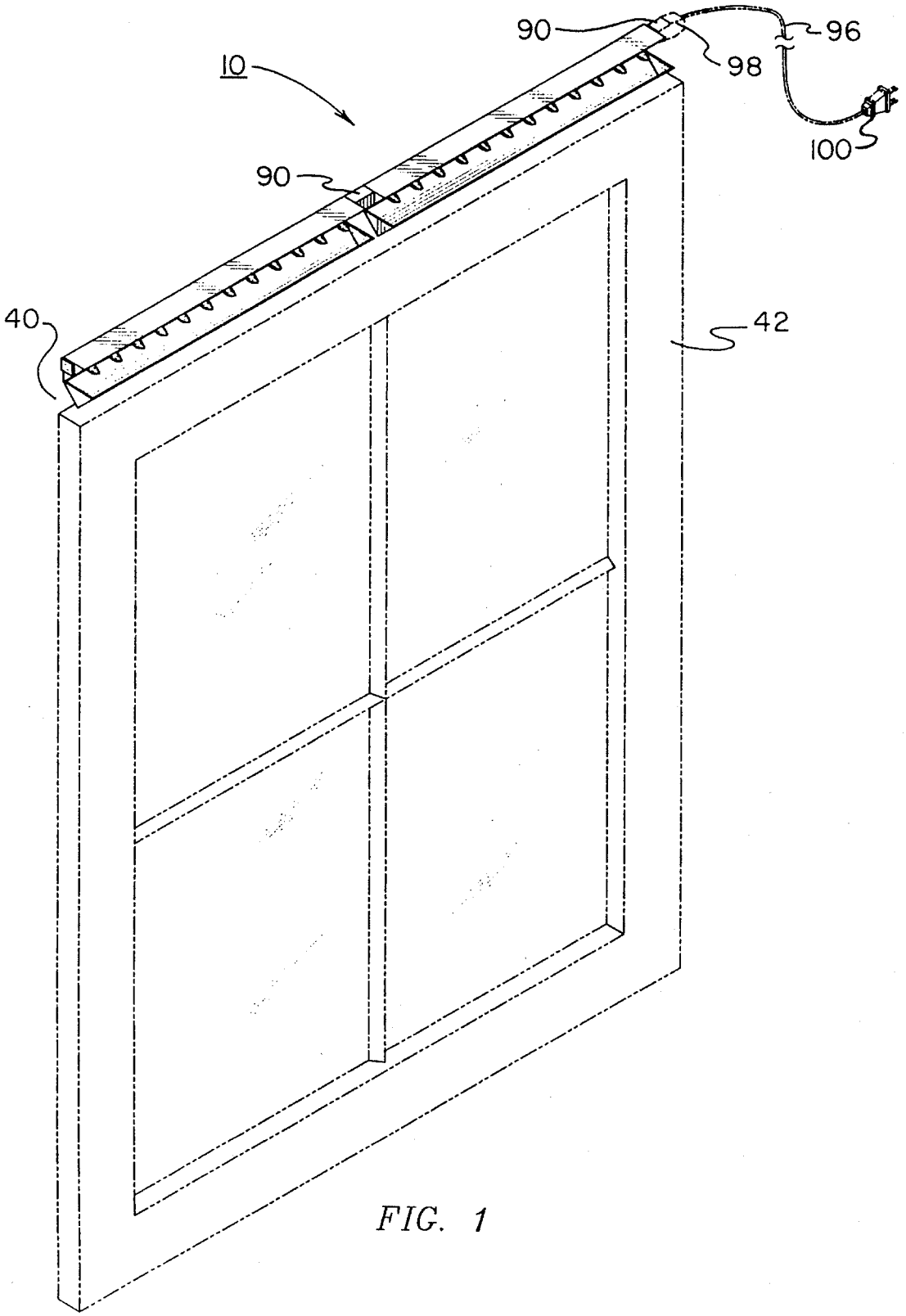
FIG. 1 is a perspective view of the preferred embodiment constructed in accordance with the principles of the present invention secured above a window of a building for providing an ornamental illuminated effect. The present invention provides a trimmed appearance to the building when placed in a closed orientation.
Figure 2:
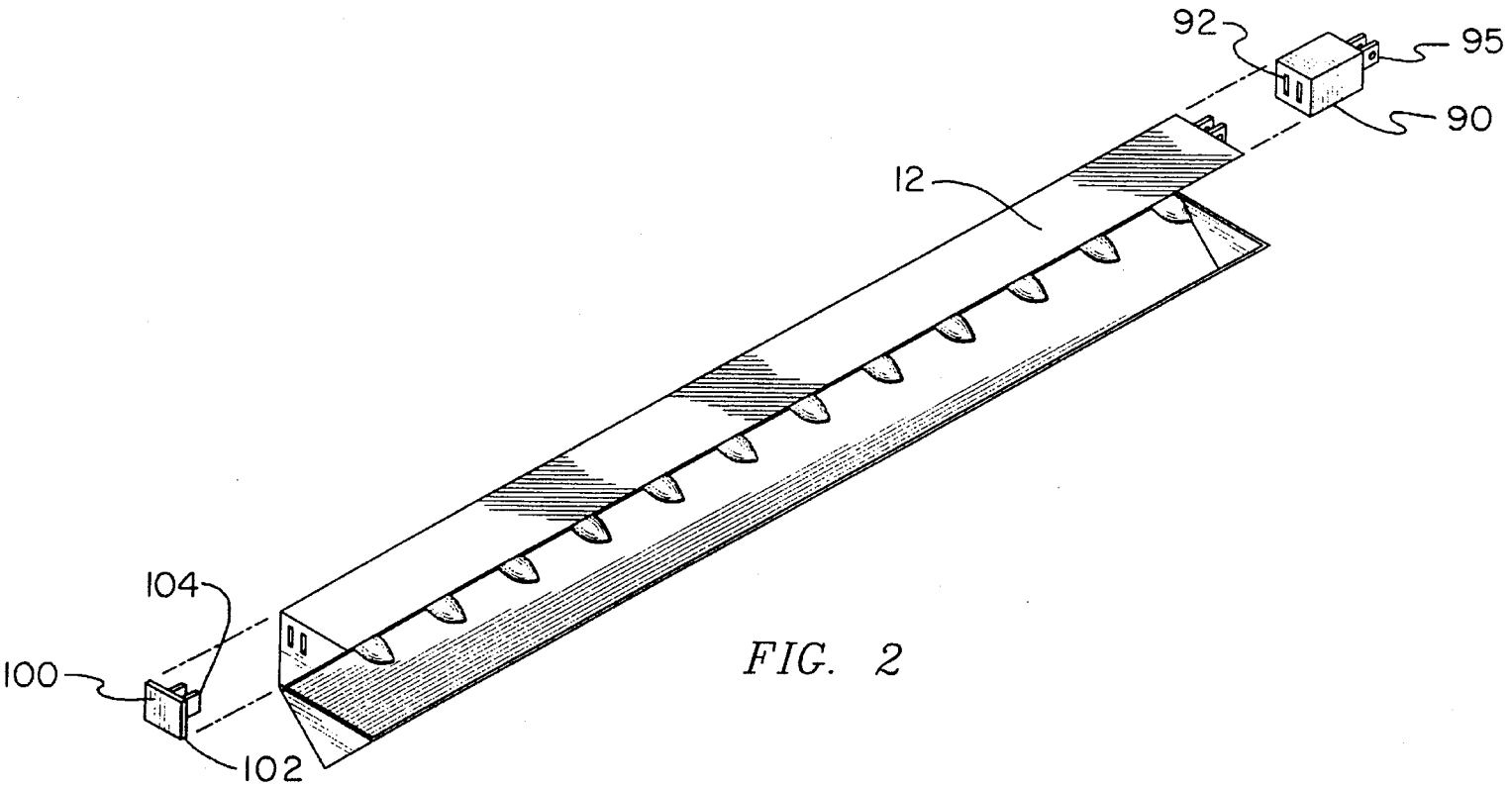
FIG. 2 is another perspective view of the preferred embodiment in an open orientation.

With reference now to the drawings, and in particular, to FIG. 1 thereof, the preferred embodiment of the new and improved decorative exterior lighting system for use on a building embodying the principles and concepts of the present invention and generally designated by the reference number 10 will be described.

The preferred embodiment of the present invention is comprised of plurality of components. In their broadest context, such components include a housing, lighting circuit, adapter plug, and end cap. Such components are individually configured and correlated with respect to each other for creating a structure that provides an ornamental illuminated effect when placed in an opened orientation and further provides a trimmed appearance to a building when placed in a closed orientation.

Figure 5:
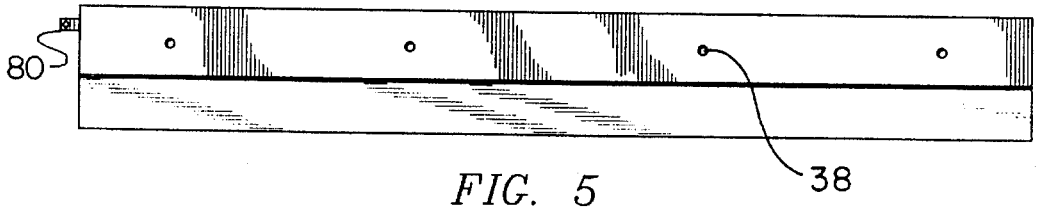
FIG. 5 is a rear elevational view of the present invention in an opened orientation.
Figure 4:
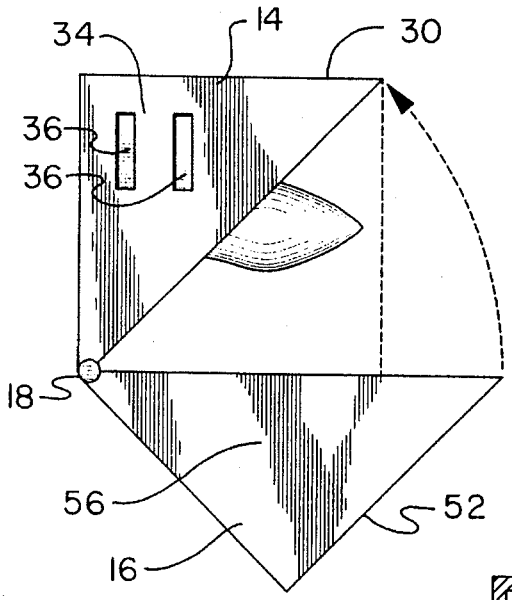
FIG. 4 is yet another side elevational view of the present invention depicting the hinged action for placing the present in a closed orientation.
Figure 6:
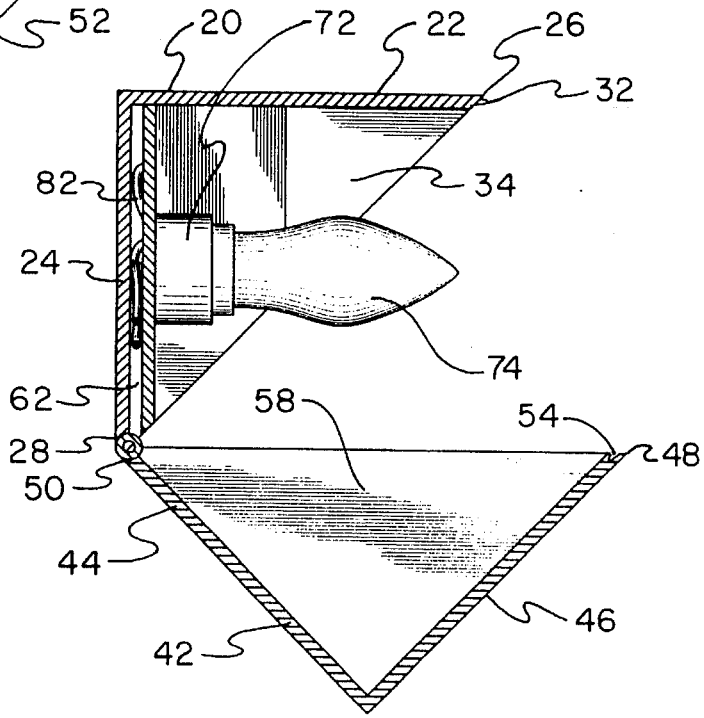
FIG. 6 is a cross-sectional view of the present invention in an opened orientation.

Specifically, the present invention includes a housing 12. The housing is elongated and box-shaped in structure. The housing is formed of a rigid impact-resistant insulated plastic. The housing may be painted to match the color scheme of a building. As shown in FIG. 6, the housing includes an upper section 14 coupled to a lower section 16 with a hinge 18. The upper section has an L-shaped upper wall 20 formed of a top portion 22 and a bottom portion 24. The portions are bounded by a front end 26, a rear edge 28, and a pair of opposed side edges 30 extended between the front edge and rear edge. A flange 32 is extended along the front edge 26 and projected outwards therefrom. The upper section also includes a pair of gussets 34. As best illustrated in FIG. 4, each gusset is coupled to a separate side edge 30 of the upper wall 20 to thereby create an upper holding space 34 as shown in FIG. 6. Additionally, each gusset includes a pair of aligned slots 36 disposed thereon. The slots are sized and spaced for receipt of a pair of prongs of a conventional male electrical plug. The bottom portion 24 of the upper wall 20 also includes a plurality of fastener holes 38 formed longitudinally thereon as shown in FIG. 5. Each fastener hole is sized for receiving a fastener for securing the upper section 14 to a recipient surface 40 such as that on a building directly above a window 42 as shown in FIG. 1.

The lower section 16 of the housing 12 has an L-shaped lower wall 42. The lower wall is formed of a top portion 44 and a bottom portion 46 as best illustrated in FIG. 6. The portions 44, 46 are bounded by a front edge 48, a rear edge 50, and a pair of opposed side edges 52 extended between the front edge 48 and rear edge 50. The front edge 48 has an elongated slot 54 formed therealong. In addition, the lower section has a pair of gussets 56 coupled to separate side edges 52 thereof to thereby create a lower holding space 58. The lower section 16 is positionable away from the upper section to place the housing in an open orientation. The front edges 26, 48 of the sections 14, 16 are snapidly securable through the use of the flange 42 and slot 54 to place the housing in a closed orientation. When placed in the closed orientation a generally box-shaped interior portion is formed.

Figure 3:
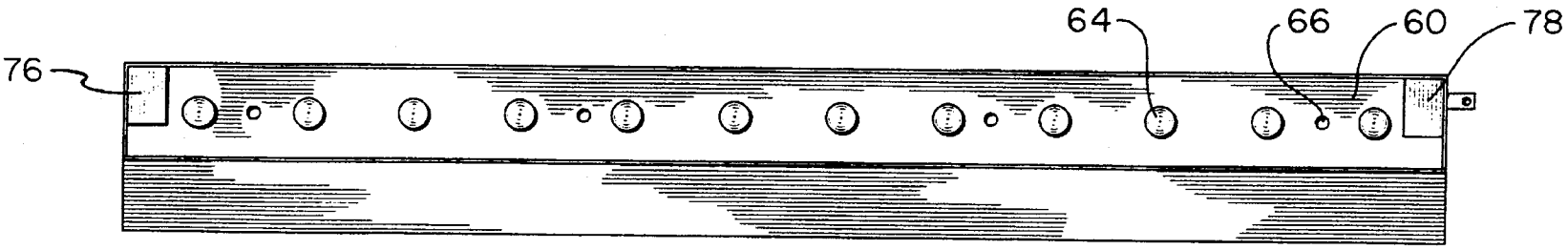
FIG. 3 is a front elevational view of the present invention in an opened orientation.

A face plate 60 is also provided. The faceplate is planar and rectangular in structure. It is formed of a rigid-impact resistant insulated plastic. The face plate is perpendicularly coupled to the top portion 22 of the upper section 14 and extended downwards into the holding space 34 in coplanar alignment with the bottom portion 24. Thus, a separate wire holding space 62 is formed between the face plate 60 and the bottom portion 24. In addition, the face plate includes a plurality of through holes 64 formed longitudinally thereon as shown in FIG. 3. Each through hole places the wire holding space 62 in communication with the upper holding space 34. Vent holes 66 are formed through the face plate and provide for heat and moisture dispensation.

Figure 7:
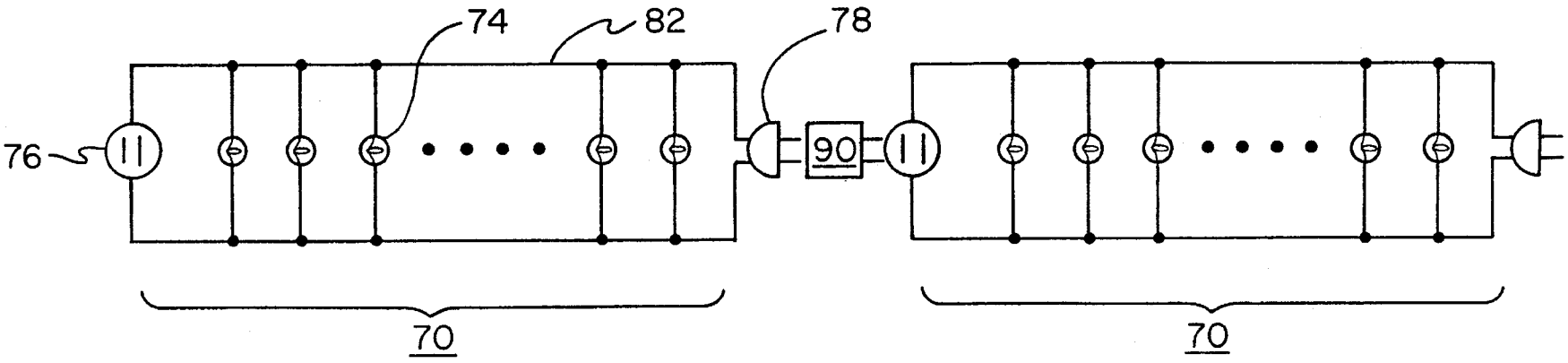
FIG. 7 is a schematic diagram of the lighting circuit of the present invention and its coupling with another such lighting circuit for extending the configuration of lights for use.

An electrical lighting circuit 70 is coupled to the housing 12. The lighting circuit 70 comprises a plurality of threaded and electrically conducted light sockets 72. Each light socket is separately disposed and secured within a through hole 64 of the face plate 60. The lighting circuit also includes a plurality of incandescent lights 74. Each light is threadedly secured within a separate light socket 72. A female electrical plug 76 is disposed within the upper holding space 34 of the upper section and coupled to one of the gussets 34 as shown in FIG. 3. The female electrical plug 76 is positioned in alignment with the slots 36 of the gusset. A male electrical plug 78 is disposed within the upper holding space 34 of the upper section and coupled to the other gusset. The plug 78 has a pair of prongs 80 projected through the slots 34 on the gusset. Lastly, a plurality of sheathed and electrically conductive wires 82 are disposed within the wire holding space 62. The wires interconnect the plugs 76, 78 and light sockets 72 in parallel as shown in FIG. 7. The lights 74 provide illumination when the lighting circuit is electrically energized the housing 12 is placed in the open orientation.

An electrical adapter plug 90 is also included. The adapter plug has a female receptacle 92 on one end and a male receptacle 94 with prongs 95 on the other end. The female receptacle 92 is removably mated with the male plug 78 of the electrical lighting circuit. The adapter plug allows another lighting circuit 70 of another same exterior lighting system 10 to be attached as shown in FIGS. 1 and 7. The adapter plug is also utilized for coupling the lighting circuit 70 with an extension cord 96. The extension cord has a outlet end 98 secured to the adapter plug and a plug end 98 securable to an external electrical power source for supplying electrical energy to the lighting circuit.

Lasting, an end cap 100 is secured to the lighting circuit 70. The end cap is formed of a rigid impact-resistant insulated plastic. The end cap has a rectangular planar plate 102 with a pair of prongs 104 projected outwards from a surface thereof. The prongs 104 of the end cap are extended through the slots 36 on the gusset 34 and removably mated with the female plug 76. The end cap thus prevents exposure of the electrical circuit to environmental conditions to preclude electrical shorting.

The present invention is a permanent replacement for exterior Christmas lights. The present invention is self-contained and requires minimal maintenance. The present invention can be mounted on boards, window framing, or such other solid material. The present invention can be placed in an opened orientation to provide a decorative effect or placed in a closed orientation to resemble exterior trim. When the lights are to be displayed, the housing can be opened quickly and easily. If a light burns out, it can be replaced with standard replacement bulbs. Standard flasher bulbs can also be placed into the system in any combination. If the present invention is not be wired directly to an electrical supply such as that of a house, common electrical cords can be utilized to connect to the system. The electrical cords can be removed when desired.

The present invention places a set of Christmas lights in a weatherproof housing that is permanently installed on the exterior of a house or other building. The principal part of this invention is a long narrow housing can be formed with a length of 16 inches, 32 inches, or 48 inches. The housing is made of two sections that are hinged together along one common edge. Each section consists of two plastic rectangular portions that are coupled at right angles to each other. The sections also include a pair of triangular gussets secured at each end thereof. A snap lock is formed between the sections and is securable when the sections are closed.

The present invention is nailed or screwed to a building through holes in its back. Additional embodiments of the present invention can be plugged into either end of another such embodiment through the use of the adapter. Therefore, generally sequential arrangements of varying lengths of the present invention can be realized. An adapter plug or spacer is plugged between a male plug of a lighting circuit of one lighting system 10 and a female plug of a lighting circuit of another lighting system. The end cap is then plugged into the last female plug of a distal lighting circuit to seal the electrical conductors from exposure. Power is applied through an extension cord that plugs onto the male conductor end of the proximal lighting circuit. A single embodiment of the present invention can also be utilized. The present invention only has to mounted once, and can be painted to match the color of a building. The cover is normally closed but can be opened during the Christmas season or other festive occasions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A decorative exterior lighting system for use on a building for providing an ornamental illuminated effect when placed in an opened orientation and further providing a trimmed appearance to the building when placed in a closed orientation comprising, in combination:

a rigid insulated elongated box-shaped housing including an upper section hingably coupled to a lower section, the upper section having L-shaped upper wall formed of a top portion and a bottom portion bounded by a flanged front edge, a rear edge, and a pair of opposed side edges extended therebetween, the upper section further having a pair of gussets with each gusset coupled to a separate side edge thereof to thereby create an upper holding space and with each gusset including a pair of aligned slots disposed thereon sized and spaced for receipt of a pair of prongs of a conventional male electrical plug, the bottom portion further having a plurality of fastener holes formed longitudinally thereon and with each fastener hole sized for receiving a fastener for securing the upper section to a recipient surface, the lower section having an L-shaped lower wall formed of a top portion and a bottom portion bounded by a slotted front edge, a rear edge, and a pair of opposed side edges extended therebetween, the lower section further having a pair of gussets coupled to a separate side edge thereof to thereby create a lower holding space and with the lower section positionable away from the upper section to place the housing in an opened orientation and with the front edges of the sections snapidly securable to place the housing in a closed orientation;

a rigid planar insulated rectangular face plate perpendicularly coupled to the top portion of the upper section and extended downwards into the upper holding space to define a separate wire holding space, the face plate including a plurality of through holes formed longitudinally therealong and with each through hole placing the wire holding space in communication with the upper holding space;

an electrical lighting circuit further comprising a plurality of threaded electrically conductive light sockets with each light socket separately disposed within a through hole of the face plate, a plurality of incandescent lights with each light threadedly secured within a separate light socket, a female electrical plug disposed within the upper holding space of the upper section and coupled to one of the gussets in alignment with the slots thereon, a male electrical plug disposed within the upper holding space of the upper section and coupled to the other gusset and with the male electrical plug having a pair of prongs projected through the slots thereon, and a plurality of sheathed electrically conductive wires disposed within the wire holding space and interconnecting the plugs and light sockets in parallel and with the lights providing illumination when the circuit is electrically energized and the housing is placed in the opened orientation;

an electrical adapter plug having a female receptacle on one end and a male receptacle on the other end and with the female receptacle removably mated with the male plug of the electrical lighting circuit and thereby allowing another lighting circuit of another same exterior lighting system to be attached; and an insulated end cap formed of a rectangular planar plate with a pair of prongs projected outwards therefrom and with the prongs of the end cap removably mated within the female plug of the lighting circuit to thereby prevent its exposure.

2. A decorative exterior lighting system comprising:

an elongated housing including a generally L-shaped upper section hingably coupled to a generally L-shaped lower section and with the lower section positionable away from the upper section to place the housing in an opened orientation and further positionable in facing contact with the upper section to place the housing a closed orientation; and an electrical lighting circuit coupled to the upper section of the housing and further comprising a plurality of electrically conductive light sockets, a plurality of lights with each light secured within a separate light socket, a female electrical plug coupled to the upper section of the housing, a male electrical plug coupled to the upper section of the housing at a location remote from the female electrical plug, and a plurality of electrically conductive wires interconnecting the plugs and light sockets and with the lights providing illumination when the lighting circuit is electrically energized and the housing is placed in the opened orientation, wherein the upper section of the housing includes a top portion and a bottom portion bounded by a flanged front edge, a rear edge, and a pair of opposed side edges extended therebetween, the upper section further including a pair of gussets with each gusset coupled to a seperate side edge thereof to thereby create an upper holding space and with each gusset including a pair of aligned slots disposed thereon sized and spaced for receipt of a pair of prongs of a conventional male electrical plug, the bottom portion further including a plurality of fastener holes formed thereon and with each fastener hole sized for receiving a fastener for securing the upper section to a recipient surface; and wherein the lower section of the housing includes a top portion and a bottom portion bounded by a slotted front edge, a rear edge, and a pair of opposed side edges extended therebetween, the lower section further including a pair of gussets coupled to a separate side edge thereof to thereby create a lower holding space, and with the front edges of the sections snapidly securable to place the housing in the closed orientation.

3. The decorative exterior lighting system as set forth in claim 2:

and further comprising a face plate perpendicularly coupled to the upper section and extended downwards to define a separate wire holding space, the face plate including a plurality of through holes formed longitudinally therealong;

wherein each light socket of the lighting circuit is separately disposed within a through hole of the face plate; and wherein the wires of the lighting circuit are disposed within the wire holding space.

4. The decorative exterior lighting system as set forth in claim 2 and further comprising an electrical adapter plug having a female receptacle on one end and a male receptacle on the other end and with the female receptacle removably mated with the male plug of the electrical lighting circuit and thereby allowing another lighting circuit of another same exterior lighting system to be attached.

5. The decorative exterior lighting system as set forth in claim 2 and further comprising an end cap formed of a plate with a pair of prongs projected outwards therefrom and with the prongs of the end cap removably mated within the female plug of the lighting circuit.

* * * * *